US008202374B2

(12) United States Patent
Kumano et al.

(10) Patent No.: US 8,202,374 B2
(45) Date of Patent: Jun. 19, 2012

(54) METHOD OF TREATING STEEL FOR GRAIN-ORIENTED ELECTRICAL STEEL SHEET AND METHOD OF MANUFACTURING GRAIN-ORIENTED ELECTRICAL STEEL SHEET

(75) Inventors: Tomoji Kumano, Tokyo (JP); Norihiro Yamamoto, Tokyo (JP); Yoshiyuki Ushigami, Tokyo (JP); Shuichi Nakamura, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 13/202,615

(22) PCT Filed: Mar. 31, 2010

(86) PCT No.: PCT/JP2010/055853

§ 371 (c)(1), (2), (4) Date: Aug. 22, 2011

(87) PCT Pub. No.: WO2010/116936

PCT Pub. Date: Oct. 14, 2010

(65) Prior Publication Data

US 2012/0037277 A1 Feb. 16, 2012

(30) Foreign Application Priority Data

Apr. 6, 2009 (JP) ..... 2009-092439

(51) Int. Cl.
*C23C 8/00* (2006.01)

(52) U.S. Cl. ..... 148/208; 148/111

(58) Field of Classification Search ..... 148/208, 148/111–113, 308

See application file for complete search history.

(56) References Cited

U.S. PATENT DOCUMENTS

| | | | | |
|---|---|---|---|---|
| 2,599,340 | A | 6/1952 | Littmann et al. | |
| 4,293,350 | A | 10/1981 | Ichiyama et al. | |
| 4,552,596 | A | 11/1985 | Ichiyama et al. | |
| 4,623,406 | A | 11/1986 | Suga et al. | |
| 4,623,407 | A | 11/1986 | Suga et al. | |
| 4,753,692 | A | 6/1988 | Kuroki et al. | |
| 4,770,720 | A | 9/1988 | Kobayashi et al. | |
| 4,863,532 | A | 9/1989 | Kuroki et al. | |
| 4,898,626 | A | 2/1990 | Shoen et al. | |
| 4,979,996 | A | 12/1990 | Kobayashi et al. | |
| 5,203,928 | A * | 4/1993 | Inokuti et al. | 148/111 |

(Continued)

FOREIGN PATENT DOCUMENTS

EP 0947597 B1 1/2005

(Continued)

OTHER PUBLICATIONS

Abstract of JP 2010-029899 A published Feb. 2010.*

(Continued)

*Primary Examiner* — Jonathan Johnson

(74) *Attorney, Agent, or Firm* — Birch, Stewart, Kolasch & Birch, LLP

(57) ABSTRACT

A surface temperature of a slab is decreased down to 600° C. or lower between start of continuous casting (step S2) and start of slab reheating (step S3). The surface temperature of the slab is held at 150° C. or higher between the start of the continuous casting (step s2) and the start of the slab reheating (step S3). The surface temperature of the slab in the slab reheating (step S3) is set to not lower than 1080° C. and not higher than 1200° C.

12 Claims, 1 Drawing Sheet

U.S. PATENT DOCUMENTS

| | | | | |
|---|---|---|---|---|
| 5,244,511 | A | 9/1993 | Komatsubara et al. | |
| 5,330,586 | A * | 7/1994 | Komatsubara et al. | 148/111 |
| 5,489,342 | A * | 2/1996 | Arai et al. | 148/111 |
| 5,620,533 | A * | 4/1997 | Kotani et al. | 148/113 |
| 6,368,424 | B1 * | 4/2002 | Sakai et al. | 148/111 |
| 6,432,222 | B2 | 8/2002 | Ohata et al. | |
| 6,613,160 | B2 | 9/2003 | Ushigami et al. | |
| 6,739,384 | B2 * | 5/2004 | Schoen et al. | 164/480 |
| 7,442,260 | B2 * | 10/2008 | Sakai et al. | 148/111 |
| 2002/0007870 | A1 | 1/2002 | Ohata et al. | |
| 2002/0038678 | A1 | 4/2002 | Ushigami et al. | |

FOREIGN PATENT DOCUMENTS

| | | | |
|---|---|---|---|
| JP | 40-15644 | | 7/1965 |
| JP | 46-23820 | | 7/1971 |
| JP | 55-18566 | A | 2/1980 |
| JP | 58-23414 | A | 2/1983 |
| JP | 59-56522 | A | 4/1984 |
| JP | 59-197520 | A | 11/1984 |
| JP | 61-117218 | A | 6/1986 |
| JP | 5-112827 | A | 5/1993 |
| JP | 6-51887 | B2 | 7/1994 |
| JP | 7-30395 | B2 | 4/1995 |
| JP | 9-227941 | A | 9/1997 |
| JP | 10-237545 | A | 9/1998 |
| JP | 2000-503726 | A | 3/2000 |
| JP | 2000-199015 | A | 7/2000 |
| JP | 2001-152250 | A | 6/2001 |
| JP | 2001-172719 | A | 6/2001 |
| JP | 2002-035805 | A * | 2/2002 |
| JP | 2002-212636 | A | 7/2002 |
| JP | 3533655 | B2 | 5/2004 |
| JP | 2010-007109 | A * | 1/2010 |
| JP | 2010-029899 | A * | 2/2010 |
| WO | WO 99/02742 | A2 | 1/1999 |

OTHER PUBLICATIONS

Abstract of JP 2002-035805A published Feb. 2002.*

Abstract of JP 2010-007109 A published Jan. 2010.*

International Search Report for PCT/JP2010/055853, mailed on Jun. 29, 2010.

N. Morito et al., "History and Recent Development of Grain Oriented Electrical Steel at Kawasaki Steel", Kawasaki Steel Giho, vol. 29, No. 3, 1997, pp. 129-135.

T. Kumano et al., "Effect of nitriding on grain oriented silicon steel bearing aluminum (the second study)", Journal of Magnetism and Magnetic Materials vol. 304, 2006, pp. e602-e607.

T. Kumano et al., "Influence of Primary Recrystallization Texture through Thickness to Secondary Texture on Grain Oriented Silicon Steel", ISIJ International , vol. 43, No. 3, 2003, pp. 400-409.

Y. Yoshitomi et al., "Coincidence Grain Boundary and Role of Primary Recrytallized Grain growth on Secondary Recrytallization Texture Evolution in Fe-3%Si Alloy", Acta Metall. Mater. vol. 42, No. 8, 1994, pp. 2593-2602.

Y. Yoshitomi et al., "Prediction Method of Sharpness of {110}<001> Secondary Recrystallization Texture of Fe-3%Si Alloy", Materials Science Forum, vols. 204-206, 1996, pp. 629-634.

* cited by examiner

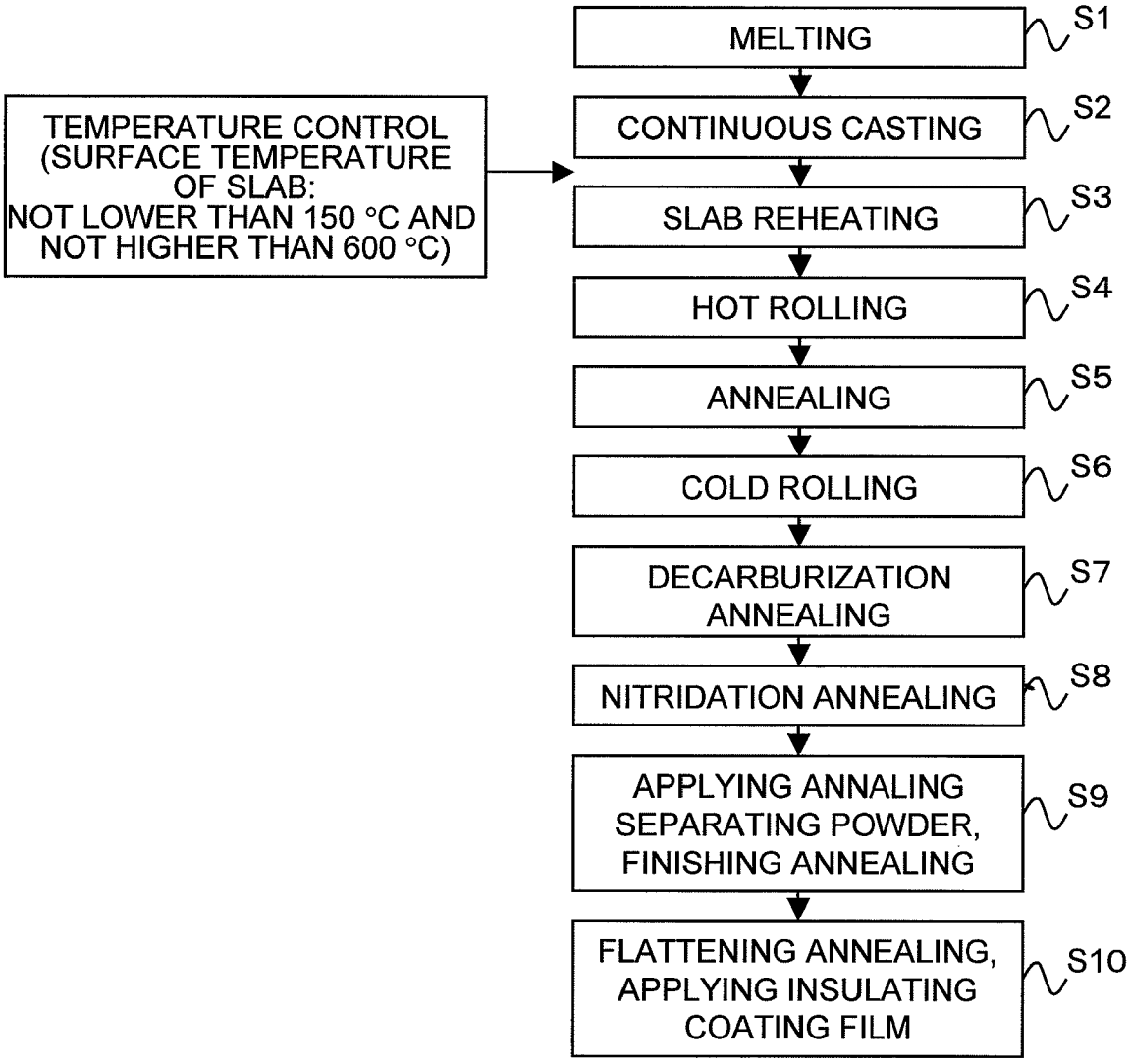
MELTING
S1
CONTINUOUS CASTING
S2
TEMPERATURE CONTROL (SURFACE TEMPERATURE OF SLAB: NOT LOWER THAN 150 °C AND NOT HIGHER THAN 600 °C)
SLAB REHEATING
S3
HOT ROLLING
S4
ANNEALING
S5
COLD ROLLING
S6
DECARBURIZATION ANNEALING
S7
NITRIDATION ANNEALING
S8
APPLYING ANNALING SEPARATING POWDER, FINISHING ANNEALING
S9
FLATTENING ANNEALING, APPLYING INSULATING COATING FILM
S10

METHOD OF TREATING STEEL FOR GRAIN-ORIENTED ELECTRICAL STEEL SHEET AND METHOD OF MANUFACTURING GRAIN-ORIENTED ELECTRICAL STEEL SHEET

TECHNICAL FIELD

The present invention relates to a method of treating steel for a grain-oriented electrical steel sheet and a method of manufacturing a grain-oriented electrical steel sheet, suitable for an iron core of a transformer and the like.

BACKGROUND ART

Main magnetic properties required in a grain-oriented electrical steel sheet are iron loss, magnetic flux density and magnetostriction. When the magnetic flux density is high, the iron core can be improved using a magnetic domain control technology. As the magnetic flux density is higher, the magnetostriction becomes smaller and improved. Further, as the magnetic flux density is higher, an exciting current in a transformer can be made smaller and the transformer can be made smaller in size. From these points, improvement in magnetic flux density is important. Further, improvement in alignment to the Goss orientation (sharpening in the Goss orientation) in a secondary recrystallization texture contributes to improvement in magnetic flux density of the grain-oriented electrical steel sheet. For the improvement the sharpness of the Goss orientation, control of an inhibitor is important and therefore various studies have been made relating to the control of the inhibitor.

Further, methods of manufacturing a grain-oriented electrical steel sheet containing aluminum includes those called a complete solid-solution non-nitriding type, a sufficient precipitation nitriding type, a complete solid-solution nitriding type, and an incomplete solid-solution nitriding type depending on the controlling method of the inhibitor. Among them, the sufficient precipitation nitriding type is preferable from the viewpoint of facility protection and achievement of excellent magnetic properties. In this method, a slab is manufactured by continuous casting, then reheating of the slab, hot rolling, annealing, cold rolling, decarburization and nitration annealing, finish annealing and so on are performed. Conventionally, since the temperature of the slab reheating is about 1150° C., the slab is carried in a manner that the loss of heat energy is suppressed between the continuous casting and the reheating. Further, cooling of the slab down to room temperature is sometimes performed before the reheating in order to treat surface flaws of the slab.

However, in the conventional manufacturing method of the sufficient precipitation nitriding type, the control of the inhibitor cannot be performed sufficiently, failing to achieve excellent magnetic properties and causing break of the slab.

CITATION LIST

Patent Literature

Patent Literature 1: Japanese Laid-open Patent Publication No. 55-018566

Patent Literature 2: Japanese Laid-open Patent Publication No. 59-197520

Patent Literature 3: Japanese Laid-open Patent Publication No. 61-117218

Patent Literature 4: Japanese Examined Patent Application Publication No. 40-15644

Patent Literature 5: Japanese Laid-open Patent Publication No. 58-023414

Patent Literature 6: U.S. Pat. No. 2,599,340

Patent Literature 7: U.S. Pat. No. 5,244,511

Patent Literature 8: Japanese Laid-open Patent Publication No. 05-112827

Patent Literature 9: Japanese Laid-open Patent Publication No. 2001-152250

Patent Literature 10: Japanese Laid-open Patent Publication No. 2000-199015

Patent Literature 11: Japanese Examined Patent Application Publication No. 40-015644

Patent Literature 12: Japanese Examined Patent Application Publication No. 46-023820

Patent Literature 13: Japanese Laid-open Patent Publication No. 09-227941

Patent Literature 14: Japanese Examined Patent Application Publication No. 06-051887

Patent Literature 15: Japanese Laid-open Patent Publication No. 59-056522

Patent Literature 16: Japanese translation of PCT publication No. 2000-503726

Patent Literature 17: Japanese Laid-open Patent Publication No. 2002-212636

Non-Patent Literature

Non-Patent Literature 1: ISIJ, Vol. 43 (2003), No. 3, pp. 400-409

Non-Patent Literature 2: Acta Metall., 42(1994), 2593

Non-Patent Literature 3: KAWASAKI STEEL GIHO Vol. 29(1997)3, 129-135

Non-Patent Literature 4: Journal of Magnetism and Magnetic Materials 304 (2006) e602-e607

Non-Patent Literature 5: Materials Science Forum Vols. 204-206 (1996) pp. 629-634

SUMMARY OF THE INVENTION

Technical Problem

An object of the present invention is to provide a method of treating steel for a grain-oriented electrical steel sheet and a method of manufacturing a grain-oriented electrical steel sheet, capable of improving magnetic properties.

Solution to Problem

The present inventors studied hard to solve the above problems and, as a result, found that the surface temperature of the slab from the continuous casting to the start of the slab reheating affects the magnetic properties of the grain-oriented electrical steel sheet in the manufacturing method of the sufficient precipitation nitriding type.

The present invention is made based on the knowledge as stated above, and a summary thereof is as described below.

A method of treating steel for a grain-oriented electrical steel sheet relating to a first aspect of the present invention includes: performing slab reheating of a slab for the grain-oriented electrical steel sheet obtained by continuous casting; performing hot-rolling of the slab to obtain a hot-rolled steel strip; performing annealing of the hot-rolled steel strip to obtain an annealed steel strip in which a primary inhibitor has precipitated; cold-rolling the annealed steel strip once or more to obtain a cold-rolled steel strip; performing decarburization annealing of the cold-rolled steel strip to obtain a decarburization-annealed steel strip in which primary recrystallization has been caused; nitriding the decarburization-annealed steel strip in a mixed gas of hydrogen, nitrogen and ammonia while running the decarburization-annealed steel strip to obtain a nitrided steel strip in which a secondary inhibitor has been introduced; applying an annealing separating powder containing MgO as a main component to the nitrided steel strip; and performing finish annealing of the nitrided steel strip to cause secondary recrystallization, wherein a surface temperature of the slab is decreased down to 600° C. or lower between start of the continuous casting and start of the slab reheating, wherein the surface temperature of the slab is held at 150° C. or higher between the start of the continuous casting and the start of the slab reheating, and wherein the surface temperature of the slab in the slab reheating is set to not lower than 1080° C. and not higher than 1200° C.

A method of manufacturing a grain-oriented electrical steel sheet relating to a second aspect of the present invention includes: performing continuous casting of molten steel for the grain-oriented electrical steel sheet to obtain a slab; performing slab reheating of the slab; then, performing hot-rolling of the slab to obtain a hot-rolled steel strip; performing annealing of the hot-rolled steel strip to obtain an annealed steel strip in which a primary inhibitor has precipitated; cold-rolling the annealed steel strip once or more to obtain a cold-rolled steel strip; performing decarburization annealing of the cold-rolled steel strip to obtain a decarburization-annealed steel strip in which primary recrystallization has been caused; nitriding the decarburization-annealed steel strip in a mixed gas of hydrogen, nitrogen and ammonia while running the decarburization-annealed steel strip to obtain a nitrided steel strip in which a secondary inhibitor has been introduced; applying an annealing separating powder containing MgO as a main component to the nitrided steel strip; and performing finish annealing of the nitrided steel strip to cause secondary recrystallization, wherein a surface temperature of the slab is decreased down to 600° C. or lower between start of the continuous casting and start of the slab reheating, wherein the surface temperature of the slab is held at 150° C. or higher between the start of the continuous casting and the start of the slab reheating, and wherein the surface temperature of the slab in the slab reheating is set to not lower than 1080° C. and not higher than 1200° C.

Advantageous Effects of Invention

According to the present invention, since the surface temperature of the slab between start of continuous casting and start of slab reheating and the surface temperature of the slab in the slab reheating are appropriately defined, the magnetic properties can be improved.

BRIEF DESCRIPTION OF DRAWINGS

FIG. 1 is a flowchart illustrating a method of manufacturing a grain-oriented electrical steel sheet according to an embodiment of the present invention.

DESCRIPTION OF EMBODIMENTS

Hereinafter, an embodiment of the present invention will be described in detail with reference to the accompanying drawings. FIG. 1 is a flowchart illustrating a method of manufacturing a grain-oriented electrical steel sheet according to the embodiment of the present invention.

In this embodiment, as illustrated in FIG. 1, steel with a composition for the grain-oriented electrical steel sheet is molten at step S1. The melting of the steel can be performed using, for example, a converter, an electric furnace or the like. Treatment of this steel is performed as follows.

Though the composition of the steel is not particularly limited, it is preferable to use steel containing C: 0.025 mass % to 0.09 mass %, Si: 2.5 mass % to 4.0 mass %, Mn: 0.05 mass % to 0.15 mass %, acid-soluble Al: 0.022 mass % to 0.033 mass %, and N: 0.005 mass % to 0.010 mass %, S equivalent of 0.004 mass % to 0.015 mass %, and the balance composed of Fe and inevitable impurities. The S equivalent here is a value found by Expression "[S]+0.405[Se]" where S content is [S] and Se content is [Se]. Further, the above composition may contain 0.02 mass % to 0.30 mass % of one or more kinds selected from a group consisting of Sb, Sn and P, may contain 0.05 mass % to 0.30 mass % of Cu, and/or may contain 0.02 mass % to 0.3 mass % of Cr. Note that the content of Ti is preferably not more than 0.005 mass %.

When the C content is less than 0.025 mass %, a primary recrystallization texture obtained by a later-described decarburization annealing (step S7) becomes inappropriate. When the C content exceeds 0.09 mass %, the decarburization annealing (step S7) becomes difficult so that the steel becomes unsuitable for industrial production.

When the Si content is less than 2.5 mass %, it becomes harder to obtain an excellent core loss. When the Si content exceeds 4.0 mass %, a later-described cold rolling (step S6) becomes very difficult so that the steel becomes unsuitable for industrial production.

When the Mn content is less than 0.05 mass %, secondary recrystallization during a later-described finish annealing (step S9) becomes hard to be stable. When the Mn content exceeds 0.15 mass %, a steel strip becomes excessively oxidized in the decarburization annealing (step S7). When the steel strip is excessively oxidized, a glass film, which exhibits no magnetization, becomes too thick, failing to obtain excellent magnetic properties. The glass film is sometimes called a forsterite film or a primary film.

S and Se bind to Mn and Cu and precipitate during a later-described slab reheating (step S3) and annealing (step S5) and so on. The precipitates (sulfide and selenide) function as inhibitors during primary recrystallization and secondary recrystallization. The inhibitor functioning during the primary recrystallization is called a primary inhibitor, and the inhibitor functioning during the secondary recrystallization is called a secondary inhibitor. The precipitates also function as precipitation nuclei of AlN to improve the secondary recrystallization. When the S equivalent is less than 0.004 mass %, the amount of inhibitor precipitated before a later-described nitridation annealing (step S8) is insufficient so that the secondary recrystallization tends to be unstable. When the S equivalent exceeds 0.015 mass %, variations in concentration distribution of S and Se increase so that the degree of solid-solution and precipitation become uneven depending on locations. As a result of this, the steel becomes unsuitable for industrial production.

Acid-soluble Al binds to N and precipitate as AlN during the slab reheating (step S3) and so on and the nitridation annealing (step S8). The AlN precipitate functions as the primary inhibitor and the secondary inhibitor. When the amount of acid-soluble Al is less than 0.022 mass %, the sharpness of a Goss orientation after the secondary recrystallization tends to be significantly broad. On the other hand, when the amount of acid-soluble Al exceeds 0.033 mass %, poor secondary recrystallization tends to occur. This is because an enough amount of AlN precipitate cannot be secured in both cases.

N precipitates as AlN as described above. The AlN precipitate functions as the primary inhibitor and the secondary inhibitor. When the N content is less than 0.005 mass %, poor secondary recrystallization tends to occur. When the N content exceeds 0.010 mass %, swelling called blister may occur to cause surface defects.

Sn, Sb and P are effective in improving the primary recrystallization texture and in forming an excellent glass film. When the total content of those elements is less than 0.02 mass %, the aforesaid effects are hardly achieved. When the total content of those elements exceeds 0.30 mass %, stable formation of the glass film becomes hard. Note that Sn, Sb, and P are segregated in a grain boundary and also have an effect of controlling the behavior of nitrogen to stabilize the secondary recrystallization.

Cu binds to S and Se and precipitates as described above. The precipitate functions as the primary inhibitor and the secondary inhibitor. Further, the precipitate also functions as a precipitation nucleus of AlN to improve the secondary recrystallization. When the Cu content is less than 0.05 mass %, this effect is hardly achieved. When the Cu content exceeds 0.30 mass %, this effect becomes saturated, and surface flaw called copper scab may be caused during hot rolling (step S4).

Cr is effective in forming the glass film. When the Cr content is less than 0.02 mass %, oxygen is hardly secured to make it difficult to form an excellent glass film. When the Cr content exceeds 0.30 mass %, it becomes sometimes difficult to form the glass film. Note that, it is more preferably that the Cr content is 0.03 mass % or more.

When the Ti content exceeds 0.005 mass %, the amount of N binding to Ti increases, thus possibly making it difficult to precipitate enough AlN functioning as the inhibitor. In this case, poor secondary recrystallization may occur.

Further, the steel may contain Ni, Mo and/or Cd. In the case of melting in the electric furnace, mixture of these elements is unavoidable. Ni presents a remarkable effect in even dispersion of the precipitates functioning as the primary inhibitor and the secondary inhibitor. Accordingly, when Ni is contained in the steel, the magnetic properties are further improved and stabilized. When the Ni content is less than 0.02 mass %, this effect is hardly achieved. When the Ni content exceeds 0.3 mass %, enrichment of oxygen becomes difficult after the decarburization annealing (step S7), thus possibly making it difficult to form the glass film. Mo and Cd precipitate as sulfide or selenide and contribute to strengthening of the inhibitor. When the total content of those elements is less than 0.008 mass %, this effect is hardly achieved. When the total content of those elements exceeds 0.3 mass %, the precipitate is coarsened and becomes hard to function as the inhibitor, thus possibly failing to stabilize the magnetic properties.

A steel with the above-described composition may be used.

After the melting, continuous casting of the molten steel is performed at step S2 to obtain a slab. The initial thickness of the slab is set to be, for example, 150 mm to 300 mm, preferably not smaller than 200 mm and preferably not larger than 250 mm. Note that vacuum degassing treatment may be performed before the continuous casting. Further, slabbing may be performed after the continuous casting.

Subsequently, at step S3, reheating of the slab is performed using a reheating furnace. In the reheating, a part of the precipitate functioning as the primary inhibitor is generated. Note that the reheating is performed under the condition of a surface temperature of the slab not lower than 1080° C. and not higher than 1200° C. The "surface temperature" here means "a surface temperature at a middle portion on the side surface of the slab" measured by a surface thermometer. When the surface temperature exceeds 1200° C., re-solid solution of the precipitate functioning as the primary inhibitor will locally occur. As a result, variations occur in the distribution of the primary inhibitor. The variations are difficult to avoid even by the hot rolling (step S4) and the annealing (step S5), and cause unevenness of the magnetic properties, so called "(reverse) skid mark." Further, the surface temperature is preferably 1150° C. or lower. On the other hand, when the surface temperature is lower than 1080° C., it is difficult to perform the hot rolling (step S4). Further, the surface temperature is preferably 1100° C. or higher.

Further, the time period of the slab reheating (step S3) is preferably within 6 hours in terms of productivity.

Further, in this embodiment, the surface temperature of the slab is decreased down to 600° C. or lower between the start of the continuous casting (step S2) and the start of the slab reheating (step S3). The temperature of the inside of the slab is higher than the surface temperature of the slab. Therefore, if the surface temperature of the slab exceeds 600° C. between the start of the continuous casting and the start of the slab reheating, the precipitate functioning as the primary inhibitor does not sufficiently precipitate. As a result, the grain size of the primary recrystallization obtained by the decarburization annealing (step S7) becomes too small, failing to achieve excellent magnetic properties.

Furthermore, when the surface temperature of the slab exceeds 600° C. between the start of the continuous casting and the start of the slab reheating, the primary inhibitor does not sufficiently precipitate as above mentioned, thus giving rise to a need to increase the time period of the slab reheating in order to obtain a sufficient precipitation state. This results in a decrease in productivity and an increase in consumption of energy. In other words, if the slab reheating is performed for over 6 hours at a low temperature and precise temperature control is performed during the slab reheating, an equilibrium state can be achieved even if the surface temperature is not decreased down to 600° C. or lower before the slab reheating, but such treatment is difficult to perform at an actual production site. On the other hand, if the surface temperature of the slab is decreased down to 600° C. or lower between the start of the continuous casting and the start of the slab reheating, the precipitate functioning as the primary inhibitor sufficiently precipitates, so that even the slab reheating within 6 hours can present excellent magnetic properties.

Note that when the slab reheating is performed using the reheating furnace, the start of the slab reheating may be synonymous with charging of the slab into the reheating furnace.

Further, in this embodiment, the surface temperature of the slab is kept at 150° C. or higher between the start of the continuous casting and the start of the slab reheating. If the surface temperature of the slab is below 150° C. between the start of the continuous casting and the start of the slab reheating, the slab is likely to break in a usual handling (cooling method). This is because the steel for the grain-oriented electrical steel sheet generally contains 2.5 mass % or more of Si. Note that the surface temperature of the slab is preferably kept at 260° C. or higher, more preferably kept at 280° C. or higher, and much more preferably kept at 300° C. or higher. This is because when Si at a higher concentration is contained in the slab, the slab is likely to break at a higher temperature, and the energy consumed in the slab reheating increases at a lower surface temperature of the slab.

Note that slabbing of the slab may be performed after the continuous casting and before the slab reheating. Also in this case, the surface temperature of the slab is decreased down to 600° C. or lower between the start of the continuous casting and the start of the slab reheating, and the surface temperature of the slab is kept at 150° C. or higher between the start of the continuous casting and the start of the slab reheating.

After the slab reheating, the hot rolling of the slab is performed at step S4. In the hot rolling, for example, rough rolling is performed first, and finish rolling is then performed. In this case, the inlet temperature of the rolling mill for finish rolling is preferably set to 960° C. or lower and the coiling temperature is preferably set to 600° C. or lower. In terms of stabilization of the secondary recrystallization, these temperatures are preferably lower. However, an inlet temperature of 820° C. or lower makes it difficult to perform the hot rolling, and a coiling temperature of 500° C. or lower makes it difficult to perform coiling. Also in this hot rolling, a precipitate functioning as the primary inhibitor is generated. By the hot rolling, a hot-rolled steel strip is obtained.

Subsequently, annealing of the hot-rolled steel strip is performed at step S5 to uniformize the structure in the hot-rolled steel strip and adjust the precipitation of the inhibitor. This annealing is an important treatment to stably obtain an excellent secondary recrystallization texture in the Goss orientation. Though the condition of the annealing is not particularly limited, the maximum temperature in the annealing is preferably set to 980° C. to 1180° C. As will be described later, the temperature maintained in the annealing may be changed at a plurality of stages, and it is preferable to set the higher temperature range to 980 ° C. to 1180° C. when the temperature is changed at the plurality of stages. Further, the time period of the temperature maintained at these temperatures is preferably set within 90 seconds. When the temperature in the annealing exceeds 1180° C., a part of the precipitate functioning as the primary inhibitor is solid-solved and sometimes finely re-precipitates. As a result of this, the grain diameter of the primary recrystallization becomes too small, making it hard to achieve excellent magnetic properties. Further, decarburization and grain growth sometimes occur in the annealing to make the quality unstable. When the temperature in the annealing is lower than 980° C., the unevenness of the precipitate, which is unevenly dispersed during the slab reheating and hot rolling, is sometimes impossible to be removed. As a result of this, variations in the magnetic properties (skid mark) sometimes occur in a coil longitudinal direction. When the time period of the temperature maintained at the aforesaid temperatures exceeds 90 seconds, the grain diameter of the primary recrystallization becomes too small depending on the temperature, making it hard to achieve excellent magnetic properties. By such annealing (step S5), an annealed steel strip is obtained.

It should be noted that the temperature maintained in the annealing may be changed at a plurality of stages as described above. For example, after the temperature is maintained at 980° C. to 1180° C., the temperature may be maintained at a temperature near 900° C. to promote the precipitation. To obtain the secondary recrystallization texture of the Goss orientation, control of the grain diameter of the primary recrystallization is important. In order to control the grain diameter of the primary recrystallization, it is also possible, in principle, to adjust the temperature in the decarburization annealing (step S7), which causes the primary recrystallization. However, in order to achieve a desired grain diameter of the primary recrystallization, the temperature in the decarburization annealing (step S7) sometimes needs to be increased to a very high temperature of above 900° C. or needs to be decreased to a very low temperature of 800° C. or lower in the actual production. In these temperature ranges, decarburization becomes difficult or the quality of the glass film deteriorates, leading to difficulty in forming a good glass film. In contrast, when the temperature is maintained at a temperature near 900° C. in the cooling after the annealing (step S5) to promote the precipitation, it becomes possible to easily achieve a desired grain diameter.

Further, from the experience of the present inventors, it is preferable that the relation of the following Expression 1 is satisfied where the temperature in the annealing (step S5) is Ta (° C.) and the surface temperature in the slab reheating (step S3) is Ts (° C.). When the relation is satisfied, especially excellent magnetic properties (iron loss and magnetic flux density) can be achieved. Note that when the maintained temperature in the annealing is changed at the plurality of stages, Ta is the maximum value of the maintained temperature.

$$Ts-Ta \leqq 70 \quad \text{(Expression 1)}$$

Further, the cooling method after the annealing is not particularly limited and, for example, the method described in Patent Literature 11, Patent Literature 12, or Patent Literature 13 may be used to cool the annealed steel strip. Further, the cooling rate is desirably set to 15° C./sec or higher in order to secure a uniform inhibitor distribution state and secure a hardened hard phase (mainly bainite phase).

After the annealing, cold rolling of the annealed steel strip is performed at step S6. The cold rolling may be performed only once, or a plurality of times of cold rolling may be performed while intermediate annealing is performed between them. By such cold rolling (step S6), a cold-rolled steel strip is obtained.

The final cold rolling rate in the cold rolling is preferably set to 80% to 92%. When the final cold rolling rate is less than 80%, the sharpness of the peak of a {110}<001> texture becomes broad in the X-ray profile of the primary recrystallization texture, making it hard to achieve a high magnetic flux density after the secondary recrystallization. When the final cold rolling rate exceeds 92%, the {110}<001> texture is very weak, the secondary recrystallization is likely to be unstable.

Further, though the temperature of the final cold rolling is not particularly limited and may be set to room temperature, it is preferable to maintain at least one pass thereof within a temperature range of 100° C. to 300° C. for one minute or longer. This is because the primary recrystallization texture is improved to make the magnetic properties very excellent. One minute or longer is enough as maintaining time period, and, at the actual production site, the maintaining time period may be often 10 minutes or longer because the cold rolling is performed using a reverse mill. An increase in maintaining time period never deteriorates but improves the magnetic properties.

Note that when the intermediate annealing is performed, the annealing of the hot-rolled steel strip before the cold rolling may be omitted and the annealing (step S5) may be performed in the intermediate annealing. In other words, the annealing (step S5) may be performed on the hot-rolled steel strip or may be performed on the steel strip before the final cold rolling after the steel strip is cold-rolled once. As these annealings, for example, continuous annealings while uncoiling the steel strip wound like a coil (continuous annealing) are performed.

After the cold rolling, decarburization annealing of the cold-rolled steel strip is performed at step S7. During the decarburization annealing, primary recrystallization is caused. And, by this decarburization annealing, a decarburization-annealed steel strip is obtained.

Though the heating condition of the decarburization annealing is not particularly limited, it is preferable that the heating rate from room temperature to 650° C. to 850° C. is set to 100° C./sec or higher. This is because the primary recrystallization texture is improved to improve the magnetic properties. Further, the methods of heating at the rate of 100° C./sec or higher include, for example, resistance heating, induction heating, directly energy input heating and the like. If the heating rate is increased, grains in the Goss orientation in the primary recrystallization texture increase and the grain diameter of the secondary recrystallization becomes small. Note that it is preferable to set the heating rate to 150° C./sec or higher.

Further, an average grain diameter of the primary crystal grains obtained through the decarburization annealing is preferably set to 20 μm to 28 μm. The average grain diameter can be controlled, for example, by the temperature of the decarburization annealing. An average grain diameter less than 20 μm hardly provides excellent magnetic properties. An average grain diameter exceeding 28 μm increases the temperature at which the secondary recrystallization comes up, possibly causing poor secondary recrystallization. Note that when the temperature of charging the slab into the reheating furnace exceeds 600° C., the grain diameter of the primary recrystallization is likely to be less than 20 μm.

After the decarburization annealing, nitridation annealing of the decarburization-annealed steel strip is performed at step S8. The nitridation forms the precipitate such as AlN or the like functioning as the secondary inhibitor. Further, by the nitridation annealing, a nitrided steel strip is obtained. In this embodiment, the decarburization-annealed steel strip is nitrided in an atmosphere containing ammonia, for example, while the decarburization-annealed steel strip is running. The methods of nitridation annealing also include a method of performing high-temperature annealing with a nitride (CrN and MnN and the like) mixed in an annealing separating powder, but it is easier to secure the stability of industrial production using the former method.

Note that the N content in the nitrided steel strip, namely, the total amount of N contained in the molten steel and N introduced by the nitridation annealing is preferably 0.018 mass % to 0.024 mass %. When the N content in the nitrided steel strip is less than 0.018 mass %, poor secondary recrystallization is sometimes caused. When the N content in the nitrided steel strip exceeds 0.024 mass %, a good glass film is not formed during the finish annealing (step S9), and a base iron may be likely to be exposed (bare spot). Further, the sharpness of the Goss orientation becomes very inferior, making it hard to achieve excellent magnetic properties.

After the nitridation annealing, an annealing separating powder containing MgO as a main component is applied to the surface of the nitrided steel strip to thereby perform finish annealing. During this finish annealing, the secondary recrystallization is caused and a glass film containing forsterite as a main component is formed on the surface of the steel strip, and purification is performed. As a result of the secondary recrystallization, a secondary recrystallization texture of the Goss orientation is obtained. Though the conditions of the finish annealing are not particularly limited, it is preferable to raise the temperature close to 1200° C. at 5° C./hour to 25° C./hour in a mixed gas atmosphere of hydrogen and nitrogen, replace the atmospheric gas with hydrogen 100% near 1200° C. and then cool the steel strip. By such finish annealing, a finish-annealed steel strip is obtained.

After the finish annealing, formation of an insulating tension coating on the surface of the finish-annealed steel strip and a flattening treatment and so on are performed at step S10.

In such a manner, the grain-oriented electrical steel sheet can be obtained.

EXAMPLE

Next, the experiments carried out by the present inventers will be described. The conditions and so on in the experiments are examples employed for confirming the practicability and the effects of the present invention, and the present invention is not limited to those examples.

First Experiment

In the first experiment, steel containing C: 0.060 mass %, Si: 3.37 mass %, Mn: 0.099 mass %, P: 0.025 mass %, S: 0.0067 mass %, Cr: 0.12 mass %, acid-soluble Al: 0.0284 mass %, N: 0.0081 mass %, Sn: 0.06 mass %, and Ti: 0.0017 mass %, and the balance composed of Fe and inevitable impurities was melted first. Then, the molten steel was continuously casted to obtain slabs with a thickness of 250 mm. Subsequently, as illustrated in Table 1, slab reheating was performed at 1070° C. to 1230° C. The time period of the slab reheating was set to 5 hours to 5.5 hours. Note that the temperatures of the slabs were continuously decreased between the start of the continuous casting and the start of the slab reheating, and the slabs were charged into the reheating furnace when the surface temperatures of the slabs dropped to 98° C. to 625° C. as illustrated in Table 1. After the slab reheating, hot rolling was started at a target of 890° C. and hot-rolled steel strips with a thickness of 2.8 mm were coiled at a target of 560° C. However, there were slabs which could not be hot-rolled.

Subsequently, the hot-rolled steel strips were annealed for 30 seconds with the temperatures of the hot-rolled steel strips set to 1130° C., maintained at 900° C. for 3 minutes, cooled down to room temperature at 25° C./sec, and subjected to acid cleaning to obtain annealed steel strips. Then, cold rolling of the annealed steel strips was performed to obtain cold-rolled steel strips with a thickness of 0.285 mm. As the cold rolling, reverse cold rolling including an aging treatment between three passes at 235° C. was performed. After the cold rolling, decarburization annealing was performed at 850° C. for 150 seconds in a wet hydrogen atmosphere to cause primary recrystallization to obtain decarburization-annealed steel strips. Then, nitridation annealing of the decarburization-annealed steel strips was performed to obtain nitrided steel strips. As the nitridation annealing, a nitriding treatment was performed in a mixed gas composed of hydrogen, nitrogen and ammonia while running the decarburization-annealed strips so that the total N content of the nitrided steel strips was about 0.021 mass %. After the nitridation annealing, an annealing separating powder containing MgO as a main component was applied to the surfaces of the nitrided steel strips to thereby perform finish annealing. This caused secondary recrystallization to obtain finish-annealed steel strips. In the finish annealing, the nitrided steel strips were raised in temperature up to 1200° C. at a rate of 10° C./hour to 20° C./hour in an atmosphere containing 25% $N_2$ gas and 75% $H_2$ gas. Further, after the temperature rise, the nitrided steel strips were subjected to a purification treatment at 1200° C. for 20 hours or longer in an atmosphere with a $H_2$ gas concentration of 100%. After the finish annealing, an insulating tension coating was formed on the surface of the finish-annealed steel strip and a flattening treatment was performed.

Then, an iron loss $W_{17/50}$ and a magnetic flux density $B_8$ were measured as the magnetic properties of samples manufactured by the above-described method. These results are illustrated in Table 1.

TABLE 1

| | No. | SURFACE TEMPERATURE AT START OF SLAB REHEATING (° C.) | SURFACE TEMPERATURE IN SLAB REHEATING (° C.) | IRON LOSS $W_{17/50}$ (W/kg) | MAGNETIC FLUX DENSITY $B_8$ (T) | NOTE |
|---|---|---|---|---|---|---|
| EXAMPLE | A1 | 162 | 1150 | 0.980 | 1.921 | |
| | A2 | 575 | 1145 | 1.020 | 1.910 | |
| | A3 | 496 | 1090 | 0.972 | 1.932 | |
| | A4 | 387 | 1190 | 0.983 | 1.922 | |
| | A5 | 463 | 1150 | 0.950 | 1.931 | |
| | A6 | 312 | 1120 | 0.935 | 1.935 | |
| COMPARATIVE EXAMPLE | a1 | 98 | 1125 | — | — | SLAB BROKE, HOT ROLLING WAS IMPOSSIBLE |
| | a2 | 625 | 1130 | 1.048 | 1.891 | |
| | a3 | 448 | 1070 | — | — | HOT ROLLING WAS IMPOSSIBLE |
| | a4 | 435 | 1230 | — | — | SKID MARK WAS GENERATED |

As illustrated in Table 1, excellent magnetic properties were achieved in Examples No. A1 to A6 satisfying the conditions defined in the present invention.

On the other hand, in Comparative Example No. a1, because of cooling down to lower than 150° C. before the slab reheating, break occurred and the hot rolling could not be performed. In Comparative Example No. a2, because of not cooling down to 600° C. or lower before the slab reheating, excellent magnetic properties could not be achieved. In Comparative Example No. a3, because of the temperature of the slab reheating being lower than 1080° C., hot rolling could not be performed. In Comparative Example No. a4, because of the temperature of the slab reheating exceeding 1200° C., a skid mark was generated.

Second Experiment

In the second experiment, steel containing C: 0.064 mass %, Si: 3.48 mass %, Mn: 0.11 mass %, P: 0.023 mass %, S: 0.0070 mass %, Cr: 0.12 mass %, acid-soluble Al: 0.0280 mass %, N: 0.0083 mass %, Cu: 0.15 mass %, Sn: 0.065 mass %, and Ti: 0.0017 mass %, and the balance composed of Fe and inevitable impurities was melted first. Then, the molten steel was continuously casted to obtain slabs with a thickness of 250 mm. Subsequently, as illustrated in Table 2, slab reheating was performed at 1070° C. to 1195° C. The time period of the slab reheating was set to 5 hours to 5.5 hours. Note that the temperatures of the slabs were continuously decreased between the start of the continuous casting and the start of the slab reheating, and the slabs were charged into the reheating furnace when the surface temperatures of the slabs dropped to 224° C. to 552° C. as illustrated in Table 2. After the slab reheating, hot rolling was started at a target of 890° C. and hot-rolled steel strips with a thickness of 2.6 mm were coiled at a target of 560° C. However, there were slabs which could not be hot-rolled.

Subsequently, as illustrated in Table 2, the hot-rolled steel strips were annealed for 25 seconds with the temperatures of the hot-rolled steel strips set to 1080° C. to 1140° C., maintained at 900° C. for 3 minutes, cooled down to room temperature at 20° C./sec, and subjected to acid cleaning to obtain annealed steel strips. Then, cold rolling of the annealed steel strips was performed to obtain cold-rolled steel strips with a thickness of 0.220 mm. As the cold rolling, reverse cold rolling including an aging treatment between three passes at 240° C. was performed. After the cold rolling, decarburization annealing was performed at 850° C. for 110 seconds in a wet hydrogen atmosphere to cause primary recrystallization to obtain decarburization-annealed steel strips. Then, nitridation annealing of the decarburization-annealed steel strips was performed to obtain nitrided steel strips. As the nitridation annealing, a nitriding treatment was performed in a mixed gas composed of hydrogen, nitrogen and ammonia while running the decarburized annealed strips so that the total N content of the nitrided steel strips was about 0.021 mass %. After the nitridation annealing, an annealing separating powder containing MgO as a main component was applied to the surfaces of the nitrided steel strips to thereby perform finish annealing. This caused secondary recrystallization to obtain finish-annealed steel strips. In the finish annealing, the nitrided steel strips were raised in temperature up to 1200° C. at a rate of 10° C./hour to 20° C./hour in an atmosphere containing 25% $N_2$ gas and 75% $H_2$ gas. Further, after the temperature rise, the nitrided steel strips were subjected to a purification treatment at 1200° C. for 20 hours or longer in an atmosphere with a $H_2$ gas concentration of 100%. After the finish annealing, an insulating tension coating was formed on the surface of the finish-annealed steel strip and a flattening treatment was performed.

Then, an iron loss $W_{17/50}$ and a magnetic flux density $B_8$ were measured as the magnetic properties of samples manufactured by the above-described method. These results are illustrated in Table 2.

TABLE 2

| | No. | SURFACE TEMPERATURE AT START OF SLAB REHEATING (° C.) | SURFACE TEMPERATURE IN SLAB REHEATING (° C.) | TEMPERATURE IN ANNEALING OF HOT-ROLLED STEEL STRIP (° C.) | IRON LOSS $W_{17/50}$ (W/kg) | MAGNETIC FLUX DENSITY $B_8$ (T) | NOTE |
|---|---|---|---|---|---|---|---|
| EXAMPLE | B1 | 450 | 1195 | 1140 | 0.820 | 1.904 | |
| | B2 | 378 | 1100 | 1130 | 0.795 | 1.922 | |
| | B3 | 552 | 1115 | 1100 | 0.798 | 1.915 | |
| | B4 | 245 | 1150 | 1115 | 0.782 | 1.919 | |
| | B5 | 340 | 1135 | 1120 | 0.775 | 1.925 | |
| | B6 | 224 | 1142 | 1120 | 0.769 | 1.930 | |
| | B7 | 448 | 1170 | 1090 | 0.901 | 1.880 | |
| | B8 | 430 | 1160 | 1080 | 0.889 | 1.875 | |
| COMPARATIVE EXAMPLE | b1 | 452 | 1230 | 1120 | — | — | SKID MARK WAS GENERATED |
| | b2 | 453 | 1070 | — | — | — | HOT ROLLING WAS IMPOSSIBLE |

As illustrated in Table 2, excellent magnetic properties were achieved in Examples No. B1 to B8 satisfying the conditions defined in the present invention. In Examples No. B7 and B8, the relation of Expression 1 is not satisfied, so that they were slightly higher in iron loss $W_{17/50}$ and slightly lower in magnetic flux density $B_8$ as compared to Examples No. B1 to B6.

On the other hand, in Comparative Example No. b1, because of the surface temperature in the slab reheating exceeding 1200° C., a skid mark was generated. In Comparative Example No. b2, because of the surface temperature in the slab reheating being lower than 1080° C., hot rolling could not be performed.

INDUSTRIAL APPLICABILITY

The present invention is applicable, for example, in an industry of manufacturing electrical steel sheets and an industry using electrical steel sheets.

The invention claimed is:

1. A method of treating steel for a grain-oriented electrical steel sheet, comprising:

performing slab reheating of a slab for a grain-oriented electrical steel sheet obtained by continuous casting;

performing hot-rolling of the slab to obtain a hot-rolled steel strip;

performing annealing of the hot-rolled steel strip to obtain an annealed steel strip in which a primary inhibitor has precipitated;

cold-rolling the annealed steel strip once or more to obtain a cold-rolled steel strip;

performing decarburization annealing of the cold-rolled steel strip to obtain a decarburization-annealed steel strip in which primary recrystallization has been caused;

nitriding the decarburization-annealed steel strip in a mixed gas of hydrogen, nitrogen and ammonia while running the decarburization-annealed steel strip to obtain a nitrided steel strip in which a secondary inhibitor has been introduced;

applying an annealing separating powder containing MgO as a main component to the nitrided steel strip; and performing finish annealing of the nitrided steel strip to cause secondary recrystallization, wherein a surface temperature of the slab is decreased down to 600° C. or lower between start of the continuous casting and start of the slab reheating, wherein the surface temperature of the slab is held at 150° C. or higher between the start of the continuous casting and the start of the slab reheating, and wherein the surface temperature of the slab in the slab reheating is set to not lower than 1080° C. and not higher than 1200° C.

2. The method of treating steel for a grain-oriented electrical steel sheet according to claim 1, wherein where a temperature in the annealing of the hot-rolled steel strip is Ta (° C.), the surface temperature of the slab in the slab reheating is Ts (° C.), a relation of "Ts−Ta≦70" is satisfied.

3. The method of treating steel for a grain-oriented electrical steel sheet according to claim 2, wherein a time period of the temperature set at Ta in the annealing of the hot-rolled steel strip is within 90 seconds.

4. The method of treating steel for a grain-oriented electrical steel sheet according to claim 1, wherein a temperature in the annealing of the hot-rolled steel strip is set to not lower than 980° C. and not higher than 1180° C.

5. The method of treating steel for a grain-oriented electrical steel sheet according to claim 2, wherein the temperature in the annealing of the hot-rolled steel strip is set to not lower than 980° C. and not higher than 1180° C.

6. The method of treating steel for a grain-oriented electrical steel sheet according to claim 3, wherein the temperature in the annealing of the hot-rolled steel strip is set to not lower than 980° C. and not higher than 1180° C.

7. A method of manufacturing a grain-oriented electrical steel sheet, comprising:

performing continuous casting of molten steel for a grain-oriented electrical steel sheet to obtain a slab;

performing slab reheating of the slab;

then, performing hot-rolling of the slab to obtain a hot-rolled steel strip;

performing annealing of the hot-rolled steel strip to obtain an annealed steel strip in which a primary inhibitor has precipitated;

cold-rolling the annealed steel strip once or more to obtain a cold-rolled steel strip;

performing decarburization annealing of the cold-rolled steel strip to obtain a decarburization-annealed steel strip in which primary recrystallization has been caused;

nitriding the decarburization-annealed steel strip in a mixed gas of hydrogen, nitrogen and ammonia while running the decarburization-annealed steel strip to obtain a nitrided steel strip in which a secondary inhibitor has been introduced;

applying an annealing separating powder containing MgO as a main component to the nitrided steel strip; and performing finish annealing of the nitrided steel strip to cause secondary recrystallization, wherein a surface temperature of the slab is decreased down to 600° C. or lower between start of the continuous casting and start of the slab reheating, wherein the surface temperature of the slab is held at 150° C. or higher between the start of the continuous casting and the start of the slab reheating, and wherein the surface temperature of the slab in the slab reheating is set to not lower than 1080° C. and not higher than 1200° C.

8. The method of manufacturing a grain-oriented electrical steel sheet according to claim 7, wherein where a temperature in the annealing of the hot-rolled steel strip is Ta (° C.), the surface temperature of the slab in the slab reheating is Ts (° C.), a relation of "Ts−Ta≦70" is satisfied.

9. The method of manufacturing a grain-oriented electrical steel sheet according to claim 8, wherein a time period of the temperature set at Ta in the annealing of the hot-rolled steel strip is within 90 seconds.

10. The method of manufacturing a grain-oriented electrical steel sheet according to claim 7, wherein a temperature in the annealing of the hot-rolled steel strip is set to not lower than 980° C. and not higher than 1180° C.

11. The method of manufacturing a grain-oriented electrical steel sheet according to claim 8, wherein the temperature in the annealing of the hot-rolled steel strip is set to not lower than 980° C. and not higher than 1180° C.

12. The method of manufacturing a grain-oriented electrical steel sheet according to claim 9, wherein the temperature in the annealing of the hot-rolled steel strip is set to not lower than 980° C. and not higher than 1180° C.

* * * * *